US009362692B2

(12) United States Patent
Tsubouchi

(10) Patent No.: US 9,362,692 B2
(45) Date of Patent: Jun. 7, 2016

(54) MULTIPOLAR CONNECTOR

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventor: Toshiyasu Tsubouchi, Yokkaichi (JP)

(73) Assignees: SUMITOMO WIRING SYSTEMS, LTD., Mie (JP); SUMITOMO ELECTRIC INDUSTRIES, LTD., Osaka (JP); AUTONETWORKS TECHNOLOGIES, LTD., Mie (JP)

( * ) Notice: Subject to any disclaimer, the term of this patent is extended or adjusted under 35 U.S.C. 154(b) by 0 days.

(21) Appl. No.: 14/410,359

(22) PCT Filed: Jun. 21, 2013

(86) PCT No.: PCT/JP2013/067056

§ 371 (c)(1),
(2) Date: Dec. 22, 2014

(87) PCT Pub. No.: WO2014/007077

PCT Pub. Date: Jan. 9, 2014

(65) Prior Publication Data

US 2015/0333459 A1 Nov. 19, 2015

(30) Foreign Application Priority Data

Jul. 3, 2012 (JP) ..... 2012-149200

(51) Int. Cl.
*H01R 13/443* (2006.01)
*H01R 24/60* (2011.01)
(Continued)

(52) U.S. Cl.
CPC ..... *H01R 24/60* (2013.01); *H01R 13/443* (2013.01); *H01R 13/42* (2013.01); *H01R 2107/00* (2013.01)

(58) Field of Classification Search
CPC ..... H01R 13/443
USPC ..... 439/676, 148, 149, 528
See application file for complete search history.

(56) References Cited

U.S. PATENT DOCUMENTS 3,434,098 A * 3/1969 Schumacher ..... H01R 31/00 439/358
6,171,144 B1 1/2001 Stone
(Continued)

FOREIGN PATENT DOCUMENTS

JP U-62-4078 1/1987
JP A-10-12354 1/1998
(Continued)

OTHER PUBLICATIONS

Aug. 6, 2013 International Search Report issued in International Application No. PCT/JP2013/067056 (including English Translation).
(Continued)

*Primary Examiner* — Tulsidas C Patel
*Assistant Examiner* — Marcus Harcum
(74) *Attorney, Agent, or Firm* — Oliff PLC

(57) ABSTRACT

A multipolar connector capable of suppressing an increase in impedance even when unused terminal-accommodating spaces are present. The multipolar connector includes a housing containing a plurality of partitioned terminal-accommodating spaces and a high-dielectric-constant body. Each of the terminal-accommodating spaces optionally contains a connecting terminal electrically connected to a wiring. The high-dielectric-constant body is formed from a material having a higher dielectric constant than air and is inserted into at least one unused terminal-accommodating space, which does not contain a connecting terminal electrically connected to a wiring.

3 Claims, 2 Drawing Sheets

(51) Int. Cl.
*H01R 107/00* (2006.01)
*H01R 13/42* (2006.01)

(56) References Cited

U.S. PATENT DOCUMENTS 6,247,965 B1 6/2001 Cummings et al.
6,808,418 B2 * 10/2004 Horner ..... H01R 13/443 439/587
7,182,651 B2 * 2/2007 Waters ..... H01R 29/00 439/681
7,270,556 B2 * 9/2007 Mori ..... H01R 13/5208 439/272
7,559,797 B2 * 7/2009 Shishikura ..... H01R 13/443 439/148
8,662,921 B2 * 3/2014 Kataoka ..... H01R 13/443 439/148
8,951,050 B2 * 2/2015 Shiratori ..... H01R 13/6471 439/660
2001/0007802 A1 7/2001 Horner
2003/0236031 A1 12/2003 Perugini et al.
2009/0305569 A1 * 12/2009 Chazottes ..... H01R 13/5213 439/655
2010/0062629 A1 3/2010 Feldman et al.

FOREIGN PATENT DOCUMENTS

JP A-2004-103396 4/2004
JP A-2011-124136 6/2011
JP A-2012-502277 1/2012

OTHER PUBLICATIONS

Apr. 29, 2015 Search Report issued in European Patent Application No. 13813193.3.

* cited by examiner

MULTIPOLAR CONNECTOR

TECHNICAL FIELD

The present subject matter relates to a multipolar connector provided with a plurality of terminal-accommodating spaces that may be used for high frequency communications.

BACKGROUND

In various devices used for high frequency communications, such as electric wires and connectors, it is known that impedances need to be matched in order to suppress the reduction of transmission efficiency due to the reflection of signals or the like in the portion in which the devices are connected to each other. See, e.g., JP 2011-124136A.

A multipolar connector to which a plurality of wirings can be connected at one time may be used for such high frequency communications. See, e.g., JP 2004-103396A (connector 33)). Such a multipolar connector can be made to be universally usable for a number of connections up to the number of terminal-accommodating spaces that are formed in the housing of the multipolar connector. For example, when two wirings are connected to each other, it is possible to use a multipolar connector provided with two or more terminal-accommodating spaces. That is, one type of multipolar connector becomes widely applicable because it may be used so long as the number of the terminal-accommodating spaces formed therein is equal to or greater than the number of wirings to be connected. As a result, it is possible to reduce the cost.

However, when a multipolar connector in which the number of the terminal-accommodating spaces formed is greater than the number of wirings to be connected, terminal-accommodating spaces that accommodate no connecting terminals (referred to as "unused terminal-accommodating spaces") are present. Therefore, there is a problem in that impedance increases due to air (having a dielectric constant of about 1) in the unused terminal-accommodating spaces, and thus transmission efficiency is reduced.

SUMMARY

It is an object of the present invention to provide a multipolar connector capable of suppressing the increase in impedance when unused terminal-accommodating spaces are present.

The multipolar connector according to the present subject matter may include a housing containing a plurality of partitioned terminal-accommodating spaces. The terminal-accommodating spaces optionally may include a connecting terminal electrically connected to a wiring.

To solve the foregoing problems, a high-dielectric-constant body formed from a material having a higher dielectric constant than air is inserted into at least one of the terminal-accommodating spaces that does not have a connecting terminal electrically connected to a wiring. The high-dielectric-constant body may be formed from a material having a higher dielectric constant than a material constituting the housing. The high-dielectric-constant body may be inserted into a terminal-accommodating space that does not contain a connecting terminal and is adjacent to a side of a terminal-accommodating space that does contain a connecting terminal.

Alternatively, the high-dielectric-constant body may be inserted into a terminal-accommodating space that does not contain a connecting terminal and is obliquely adjacent to a terminal-accommodating space that does contain a connecting terminal.

The high-dielectric-constant body formed from a material having a higher dielectric constant than air (i.e., insulating material) is inserted into an unused terminal-accommodating space. As a result, it is possible to suppress the increase in impedance as compared to a multipolar connector in which nothing is inserted into the unused terminal-accommodating space, that is, where air, which has a low dielectric constant, is present in the unused terminal-accommodating space. Specifically, it is possible to suppress the increase in impedance even when there are unused terminal-accommodating spaces due to the use of a versatile multipolar connector without forming separate connectors depending on the application.

Moreover, when the high-dielectric-constant body is formed from a material having a higher dielectric constant than a material constituting the housing, it is possible to further suppress the increase in impedance.

In a preferred embodiment, the high-dielectric-constant body may be present at a position closer to a connecting terminal in order to suppress the increase in impedance. Therefore, if there is a demand for the reduction of the number of high-dielectric-constant bodies to be used, e.g., to reduce costs, the priority order of the positions into which the high-dielectric-constant bodies are inserted may be set so that the unused terminal-accommodating spaces that are adjacent to a side of a terminal-accommodating space containing a connecting terminal have higher priority than the unused terminal-accommodating spaces that are not adjacent to a side of a terminal-accommodating space containing a connecting terminal. Additionally, unused terminal-accommodating spaces that are obliquely adjacent or cater-corner to a terminal-accommodating space containing a connecting terminal have a lower priority than those unused terminal-accommodating spaces that are adjacent to a side of a terminal-accommodating space containing a connecting terminal, but have a higher priority than those unused terminal-accommodating spaces that are not adjacent at all to a terminal-accommodating space containing a connecting terminal.

DETAILED DESCRIPTION

Figure 1A:
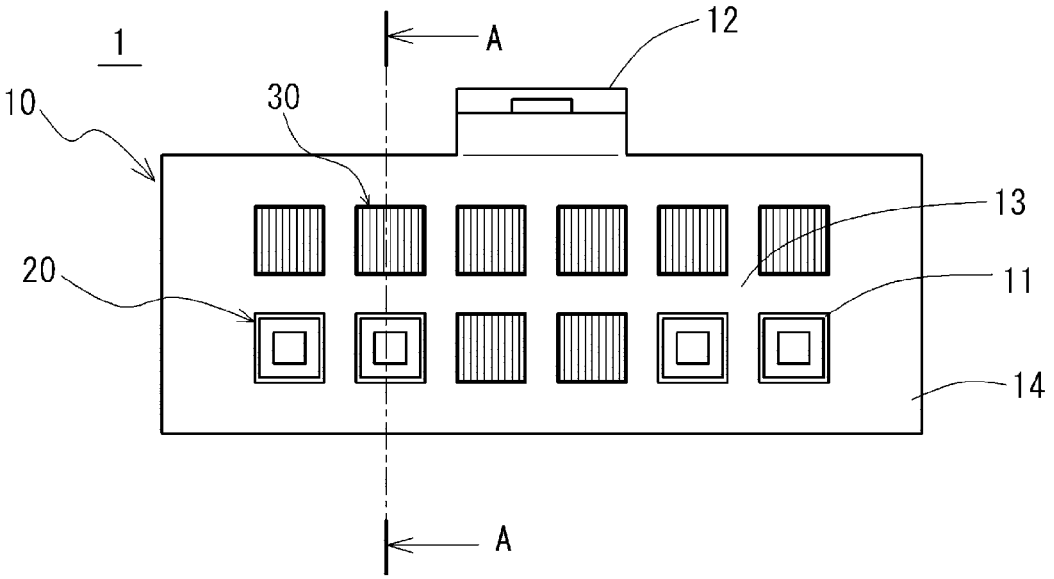
FIG. 1A shows a front view of a multipolar connector.

The multipolar connector has a height direction, a width direction, and a fitting direction. The "height direction" as used herein refers to the vertical direction along line A-A in the multipolar connector, as shown in FIG. 1A. The "width direction" and the "fitting direction" are transverse, preferably perpendicular, to each other and define a plane that is orthogonal to the height direction. In particular, the "width direction" as used herein refers to the horizontal direction in FIG. 1A that is transverse, preferably perpendicular, to the height direction alone line A-A. The "width direction" may be in a direction of a line of terminal accommodating spaces that is transverse, preferably perpendicular, to line A-A. The "fitting direction" as used herein refers to a direction orthogonal to the height direction and the width direction. The "fitting direction" refers to the direction in which a mating connector is fitted to the multipolar connector.

Figure 1B:
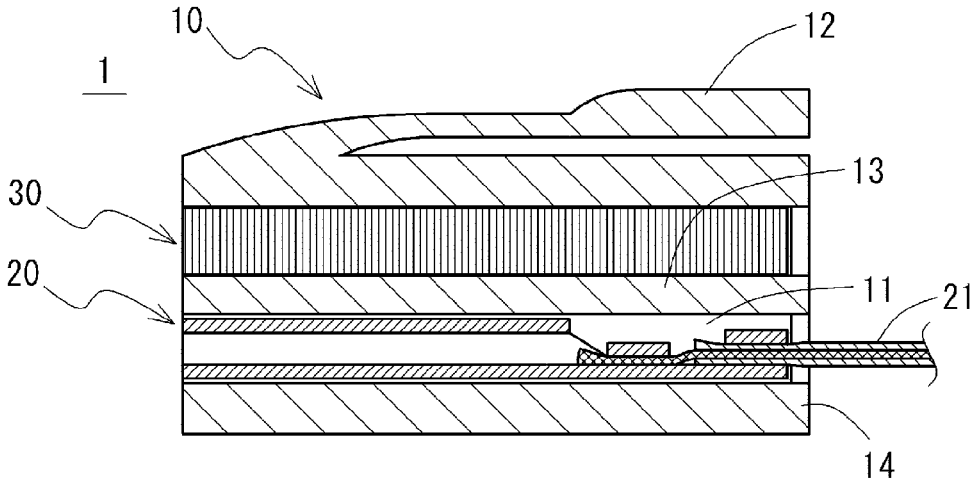
FIG. 1B shows a cross-sectional view of the multipolar connector in FIG. 1A taken along line A-A.

The multipolar connector 1 may be a vehicle-mounted connector used for high frequency communications in a vehicle, such as a GPS. As shown in FIGS. 1A and 1B, the multipolar connector 1 may have a housing 10 that is provided with a plurality of terminal-accommodating spaces 11 partitioned by a partition wall 13. The number of the terminal-accommodating spaces 11 is not limited to a certain number. The terminal-accommodating spaces 11 may be formed so as to line up in the width direction and the height direction in a grid pattern as viewed from the fitting direction. The housing 10 may be provided with a locking portion 12 for maintaining a state where the multipolar connector 1 is fitted to a mating connector (not shown). As locking configurations are well-known in the art, the locking portion 12 (a fitting mechanism of the mating connector) may be any locking configuration of a connector known in the art.

Figure 2:
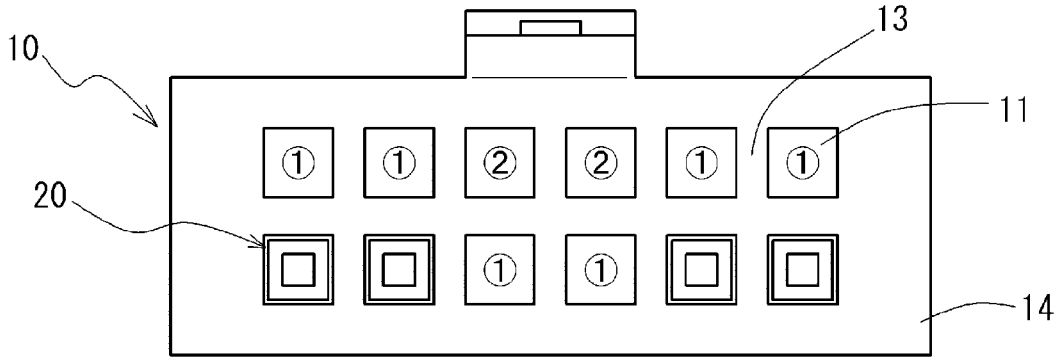
FIG. 2 illustrates the priority order of terminal-accommodating spaces into which high-dielectric-constant bodies may be inserted (the number of poles is 12).
Figure 3:
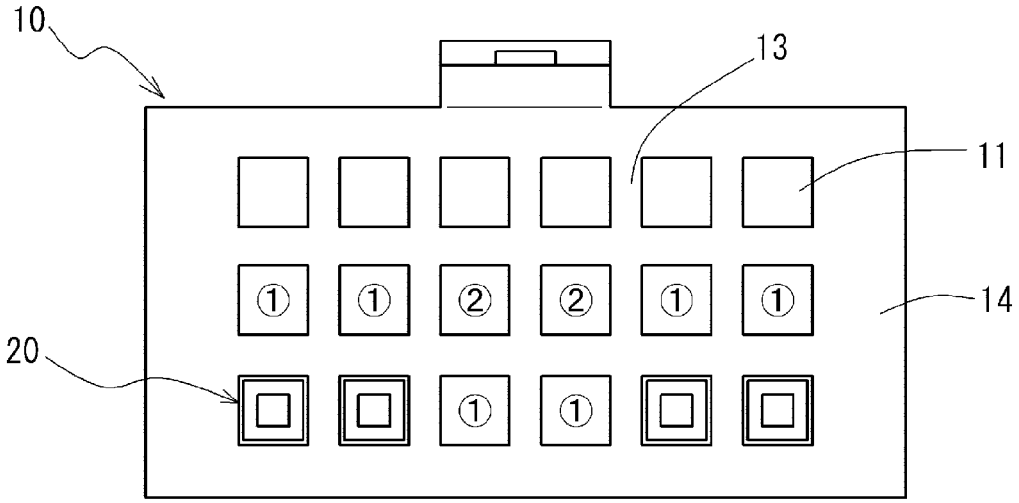
FIG. 3 illustrates the priority order of terminal-accommodating spaces into which high-dielectric-constant bodies may be inserted (the number of poles is 18).

The terminal-accommodating spaces 11 formed in the housing 10 are spaces that are capable of accommodating connecting terminals 20 that are connected to the end portions (e.g., core wires) of wirings, e.g., electric wires 21. That is, the maximum number of the wirings that can be connected at one time corresponds to the number of the terminal-accommodating spaces 11 (hereinafter, the number of the wirings that can be connected to the multipolar connector 1 may be also referred to as "maximum connectable number"). In other words, when the number x of the wirings to be connected is not more than the maximum connectable number X of the multipolar connector 1 (when the relationship $x \leq X$ is given), the multipolar connector 1 may be used for the connection of the wirings. FIGS. 1 to 3 show an example of a connector used for the connection of twisted pair cables in which two electric wires are paired, and therefore, the connecting terminals 20 are adjacently accommodated in the terminal-accommodating spaces 11 adjacent to each other.

When the maximum connectable number X of the multipolar connector 1 is more than the number x of the wirings to be connected, that is, when the relationship may be represented by $x<X$, some of the terminal-accommodating spaces 11 are not used for the connection of the wirings. In a multipolar connector 1 having unused terminal-accommodating spaces, high-dielectric-constant bodies 30 formed from a material having a higher dielectric constant than air (i.e., insulating material) may be inserted into the unused terminal-accommodating spaces 11, which are not used for the connection. The high-dielectric-constant body 30 needs only to be formed so that it may be inserted into the terminal-accommodating space 11. When the high-dielectric-constant body 30 has been inserted into the terminal-accommodating space 11, the gap between the housing 10 and the high-dielectric-constant body 30 (i.e., the gap between a wall surface of the housing 10 that faces the terminal-accommodating space 11 and an outer surface of the high-dielectric-constant body 30) may be as small as possible. For reuse of the used connectors, a correction in assembly, or the like, the size of the gap may only be set so that the high-dielectric-constant body 30, which has been once inserted into the terminal-accommodating space 11, can be easily removed. Even if the size of the gap is set in this manner, there are no problems because the mating connector prevents the high-dielectric-constant body 30 from coming off when the mating connector is fitted to the multipolar connector 1.

In one embodiment, the high-dielectric-constant body 30 formed from a material having a higher dielectric constant than air may be inserted into the unused terminal-accommodating space 11 in a multipolar connector 1. As a result, it is possible to suppress the increase in impedance as compared to an embodiment where nothing is inserted into the unused terminal-accommodating space 11, that is, where air, which has a low dielectric constant, is present in the unused terminal-accommodating space 11. Accordingly, the multipolar connector 1 is versatile in that it can be used when the maximum connectable number X of the multipolar connector 1 is greater than or equal to the number x of the wirings to be connected ($x \leq X$). In addition to being versatile, the multipolar connector 1 suppresses the increase in impedance due to the maximum connectable number X being greater than the number x of the wirings to be connected ($x<X$).

To further suppress the increase in impedance, the dielectric constant of the high-dielectric-constant body 30 may be further increased. Specifically, the high-dielectric-constant body 30 may be formed from a material having a higher dielectric constant than a material constituting the housing 10. For example, the housing 10 may be constituted by polybutylene terephthalate (PBT), which has a dielectric constant of about 3.4, syndiotactic polystyrene (SPS), which has a dielectric constant of about 3.4, or acrylonitrile butadiene styrene (ABS), which has a dielectric constant of about 3.0. The high-dielectric-constant body 30 may be constituted by SPS containing glass fiber, which has a dielectric constant of about 3.8, SPS sold under the trademark XAREC (manufactured by Idemitsu Kosan Co., Ltd.), which has a dielectric constant of about 5 to 15, or polyphenylene sulfide (PPS) and liquid crystal polymer (LCP) sold under the trademark, FREQTIS (manufactured by Otsuka Chemical Co., Ltd.), which has a dielectric constant of about 5 to 15. The impedance of the connecting terminal 20 may also be matched with the impedance of the mating connector to reduce a loss due to the reflection of signals. Therefore, the material for the high-dielectric-constant body 30 may be selected based on the impedance of the mating connector.

To suppress the increase in impedance, the high-dielectric-constant bodies 30 may be inserted into all of the unused terminal-accommodating spaces 11 as in the configuration shown in FIG. 1A. However, to reduce costs associated with cost of the material for the high-dielectric-constant body and/or the complicated assembly work, high-dielectric-constant bodies 30 may not be inserted into all of the unused terminal-accommodating spaces 11. In such an embodiment, the positions into which the high-dielectric constant bodies 30 are inserted may be based on the following priority order.

To suppress the increase in impedance, it is desirable that the high-dielectric-constant bodies 30 are first inserted into unused terminal-accommodating spaces 11 that are closest to the connecting terminal 20. That is, the unused terminal-accommodating spaces 11 adjacent to a side, e.g., an upper, lower, right, or left side, of a terminal-accommodating space 11 accommodating a connecting terminal 20 may be set to the highest priority for insertion of a high-dielectric-constant body 30 (i.e., the positions denoted by the number "1" in FIGS. 2 and 3). The unused terminal-accommodating spaces 11 that are obliquely adjacent (i.e., diagonally adjacent) to the terminal-accommodating spaces 11 accommodating a connecting terminal 20 may be set as to have the second highest priority for insertion of a high-dielectric-constant body 30 (i.e., the positions denoted by the number "2" in FIGS. 2 and 3).

The phrase "obliquely adjacent to" as used herein refers to a position of an unused terminal-accommodating space 11 that is not adjacent to a side of a terminal-accommodating space 11 containing a connecting terminal 20, but is diagonally adjacent or cater-cornered to a terminal-accommodating space 11 containing a connecting terminal 20. For example, a second priority unused terminal-accommodating space 11 may be one that is located at a position above or below a first priority unused terminal-accommodating space 11 located on the right or left side of a terminal-accommodating space 11 accommodating a connecting terminal 20.

In a preferred embodiment, the connecting terminals 20 in the terminal-accommodating spaces 11 may be disposed along the outer wall 14 of the housing 10 as far as possible. Preferably, the connecting terminal 20 may be disposed in any of terminal-accommodating spaces 11 located at the corners (of a grid pattern), as shown in FIGS. 2 and 3. Generally, the outer wall 14 of the housing 10 may be formed so as to be thicker than the partition wall 13 that partitions the terminal-accommodating spaces 11. Therefore, it is efficient to dispose the connecting terminal 20 in the terminal-accommodating space 11 along the outer wall 14 of the housing 10 because the outer wall 14 serves as an insulating body that suppresses an increase in impedance.

In such an embodiment, when one connecting terminal 20 and another connecting terminal 20 are fixed to the housing 10 apart from each other, it is desirable that the high-dielectric-constant body 30 is inserted into the unused terminal-accommodating spaces 11 that are present between the two connecting terminals 20. For example, if the two connecting terminals 20 are disposed at the same height, then it is desirable that the high-dielectric-constant body 30 is inserted into the unused terminal-accommodating spaces 11 at the same height between the two connecting terminals 20.

The number of poles of the multipolar connector 1, that is, the number of terminal-accommodating spaces 11 formed in the housing 10 is not limited and may be set as appropriate. Similarly, the size of the housing 10, the shape of the connecting terminal 20, and the like may be set as appropriate While embodiments of the present subject matter have been described in detail, the present subject matter is not limited to the above-described embodiments, and various modifications may be made without departing from the concept of the present subject matter.

The invention claimed is:

1. A multipolar connector comprising:

a housing containing a plurality of partitioned terminal-accommodating spaces, each of the terminal-accommodating spaces optionally comprising a connecting terminal electrically connected to a wiring; and a high-dielectric-constant body inserted into at least one of the terminal-accommodating spaces that does not comprise a connecting terminal electrically connected to a wiring;

wherein the high-dielectric-constant body comprises a material that has a higher dielectric constant than air and has a higher dielectric constant than a material constituting the housing and that has an impedance that is matched to an impedance of a connector mated to the multipolar connector, and wherein the high-dielectric constant body is solid.

2. The multipolar connector according to claim 1, wherein the at least one terminal-accommodating space into which the high-dielectric-constant body is inserted is adjacent to a side of at least one of the terminal-accommodating spaces comprising a connecting terminal electrically connected to a wiring.

3. The multipolar connector according to claim 2, wherein the at least one terminal-accommodating space into which the high-dielectric-constant body is inserted is obliquely adjacent to at least one of the terminal-accommodating spaces comprising a connecting terminal electrically connected to a wiring.

* * * * *